US011585497B2

(12) United States Patent
Lin et al.

(10) Patent No.: US 11,585,497 B2
(45) Date of Patent: Feb. 21, 2023

(54) STRIP LAMP

(71) Applicant: XIAMEN LEEDARSON LIGHTING CO.,LTD, Fujian (CN)

(72) Inventors: Junjie Lin, Fujian (CN); Shaomei Liang, Fujian (CN); Lei Zhang, Fujian (CN)

(73) Assignee: XIAMEN LEEDARSON LIGHTING CO., LTD, Fujian (CN)

( * ) Notice: Subject to any disclaimer, the term of this patent is extended or adjusted under 35 U.S.C. 154(b) by 0 days.

(21) Appl. No.: 17/086,316

(22) Filed: Oct. 30, 2020

(65) Prior Publication Data

US 2021/0372577 A1 Dec. 2, 2021

(30) Foreign Application Priority Data

May 28, 2020 (CN) ..... 202020940738.7

(51) Int. Cl.

| | |
|---|---|
| ***F21S 4/28*** | (2016.01) |
| ***F21V 1/00*** | (2006.01) |
| ***F21V 17/10*** | (2006.01) |
| ***F21Y 103/10*** | (2016.01) |
| ***F21Y 115/10*** | (2016.01) |

(52) U.S. Cl.

CPC ..... *F21S 4/28* (2016.01); *F21V 1/00* (2013.01); *F21V 17/104* (2013.01); *F21Y 2103/10* (2016.08); *F21Y 2115/10* (2016.08)

(58) Field of Classification Search

CPC ..... F21S 4/28; F21V 17/104; F21K 9/275

See application file for complete search history.

(56) References Cited

U.S. PATENT DOCUMENTS

| | | | | |
|---|---|---|---|---|
| 7,988,335 | B2 * | 8/2011 | Liu | F21V 29/89 362/294 |
| 2009/0219713 | A1 * | 9/2009 | Siemiet | F21V 15/013 362/218 |
| 2010/0020542 | A1 * | 1/2010 | Teng | F21V 15/015 362/249.05 |
| 2011/0058377 | A1 * | 3/2011 | Chou | F21S 4/28 362/294 |
| 2011/0075416 | A1 * | 3/2011 | Chou | F21S 4/28 362/235 |
| 2011/0090687 | A1 * | 4/2011 | Lin | F21K 9/275 362/235 |
| 2011/0103053 | A1 * | 5/2011 | Chen | F21K 9/68 362/235 |

(Continued)

*Primary Examiner* — William N Harris

(74) *Attorney, Agent, or Firm* — Chun-Ming Shih; Lanway IPR Services

(57) ABSTRACT

A strip lamp includes a body, a lampshade, an illuminating component and a holder. The body includes a support wall and a tilt wall. The tilt wall is connected to the support wall's two opposite lateral sides. Also, the tilt wall forms an included angle between the tilt wall's two opposite lateral sides. The lampshade is detachably engaged with the body and is detachably connected to the tilt wall's both lateral sides. The illuminating component is installed on the support wall to face against the lampshade's inner surface. The illuminating component's illuminating span angle is smaller than or equal to the tilt wall's included angle. The holder is detachably engaged with the body. In addition, the holder loads the illuminating component.

13 Claims, 6 Drawing Sheets

(56) References Cited

U.S. PATENT DOCUMENTS

| | | | | |
|---|---|---|---|---|
| 2011/0149563 | A1* | 6/2011 | Hsia | H01R 33/945 362/221 |
| 2011/0176298 | A1* | 7/2011 | Meurer | F21K 9/27 362/218 |
| 2011/0211330 | A1* | 9/2011 | Wang | F21K 9/66 362/20 |
| 2011/0280020 | A1* | 11/2011 | Chen | F21K 9/69 362/294 |
| 2012/0201023 | A1* | 8/2012 | Yoneda | F21V 29/83 362/218 |
| 2012/0218757 | A1* | 8/2012 | Gill | F21V 29/74 362/235 |
| 2013/0242570 | A1* | 9/2013 | Chen | F21V 15/01 362/362 |
| 2013/0314917 | A1* | 11/2013 | Su | F21K 9/275 362/235 |
| 2014/0078771 | A1* | 3/2014 | Chen | F21V 29/70 362/555 |
| 2014/0313731 | A1* | 10/2014 | Kwak | F21V 17/06 362/294 |
| 2016/0025277 | A1* | 1/2016 | Spinelli | F21V 23/06 362/223 |
| 2016/0312961 | A1* | 10/2016 | Kwon | F21V 17/108 |
| 2017/0350579 | A1* | 12/2017 | Kwak | F21S 4/28 |
| 2019/0011088 | A1* | 1/2019 | Kim | F21V 7/06 |
| 2021/0116080 | A1* | 4/2021 | Tan | F21V 21/005 |

* cited by examiner

STRIP LAMP

FIELD

The present invention relates to a strip lamp, and more particularly, to a strip lamp capable of uniformly illuminating.

BACKGROUND

A conventional strip lamp includes a body, a lampshade and an illuminating unit. The body has a substantially flat surface. And the lampshade is installed on the body's surface for encapsuling the illuminating unit between the body's surface and the lampshade. However, the conventional strip lamp's luminance substantially centers at its center. Such that the conventional strip lamp's both sides are significantly darker than its center. In other words, the conventional strip lamp illuminates in a highly uneven manner.

SUMMARY

The present disclosure aims at disclosing a strip lamp that includes a body, a lampshade, an illuminating component and a holder. The body includes a support wall and a tilt wall. The tilt wall is connected to the support wall's two opposite lateral sides. Also, the tilt wall forms an included angle between the tilt wall's two opposite lateral sides. The lampshade is detachably engaged with the body and is detachably connected to the tilt wall's both lateral sides. The illuminating component is installed on the support wall to face against the lampshade's inner surface. The illuminating component's illuminating span angle is smaller than or equal to the tilt wall's included angle. The holder is detachably engaged with the body. In addition, the holder loads the illuminating component.

In one example, both the body and the lampshade are strip-shaped.

In one example, the support wall is connected to the tilt wall in an integral manner.

In one example, the lampshade includes a transparent material.

In one example, the lampshade is half-cylinder-shaped.

In one example, the strip lamp includes a terminal cap that caps a lateral opening of the lampshade.

In one example, the illuminating component's illuminating span angle is substantially ranged between 115° and 125°.

In one example, the illuminating component's illuminating span angle is approximately 120°.

In one example, the illuminating component includes a base and a planar bulb. The base is disposed on the support wall. The planar bulb is disposed on the base's surface.

In one example, the base includes a metal material.

In one example, the base is strip-shaped.

In one example, the planar bulb includes a light-emitting diode (LED) unit.

In one example, the support wall includes a groove that in turn includes two openings respectively disposed at the support wall's two lateral sides. Besides, the base engages with the groove via a tongue-and-groove fit or a snap-in fit.

In one example, the groove includes two mutually-opposite-faced recesses. Moreover, the strip lamp includes a tongue that is disposed at the intersection of the support wall and the tile wall. In addition, each of the recesses is formed between a corresponding tongue and the support wall.

In one example, the base is pushed into the groove via the groove's openings for entering into the groove.

In one example, the tilt wall is symmetrically disposed around the support wall's two opposite lateral sides.

In one example, the illuminating component includes a base and a plurality of linear-aligned planar bulbs. The base is disposed on the support wall. Moreover, the plurality of linear-aligned planar bulbs are disposed on the base's surface. Additionally, the plurality of linear-aligned planar bulbs are separated in substantially-equal distances.

In one example, the plurality of planar bulbs are linearly aligned along the support wall.

In one example, the plurality of planar bulbs are linearly aligned along the support wall's center line.

In one example, the lampshade includes a plurality of hooks that are disposed at the lampshades opposite sides. Besides, the tilt wall includes an indentation that is disposed at the tilt wall's external side for detachably engaging a corresponding hook out of the plurality of hooks.

In one example, the indentation detachably engages with the corresponding hook in a groove-and-tongue fit or a snap-in fit.

In one example, the tilt wall includes a first limiter, a positioning wall and a second limiter. The first limiter extends from the tilt wall's external side. The positioning wall extends from the tilt wall's external side. The second limiter extends from the positioning wall. Also, a combination of the first limiter, the positioning wall and the second limiter forms a C-shaped hook that surrounds the indentation.

In one example, the strip lamp includes an installation opening that is formed between the first limiter and the second limiter. Besides, the installation opening substantially connects with the indentation. In addition, the first limiter detachably engages with the corresponding hook for limiting the lampshade's vertical relative movement with the body. The second limiter limits the lampshade's lateral movement for stopping the lampshade from detaching from the indentation.

In one example, the holder includes two separated first sidewalls that extend along the strip lamp's longitudinal axis. The strip lamp also includes an installation opening that is formed between the two separated first sidewalls. Moreover, the body includes two second sidewalls that connect to the tilt wall's external side. Additionally, the body extends along the strip lamp's longitudinal axis. On top of that, both the second sidewalls are located at the support wall's two opposite sides and respectively disposed external to the two first sidewalls. In addition, the body covers and clamps the installation opening.

In one example, the installation opening holds a control panel.

In one example, each the first sidewall includes a first snap. And each the second sidewall includes a second snap that engages with the first snap using a snap-in fit.

In one example, the holder is strip-shaped.

In one example, the holder includes a rectangular housing.

In one example, the holder further includes an outwardly-extending first snap at its two sides respectively. Also, the body includes an inwardly-extending second snap at its two sides respectively. Additionally, the body detachably engages the first snap with the second snap or disengages the first snap from the second snap.

In one example, the first snap includes a protrusion, and the second snap comprises a groove. Besides, the groove and the protrusion form a groove-and-tongue fit along the strip lamp's longitudinal axis.

DETAILED DESCRIPTION

As mentioned above, the present disclosure discloses a strip lamp capable of illuminating uniformly.

Figure 1:
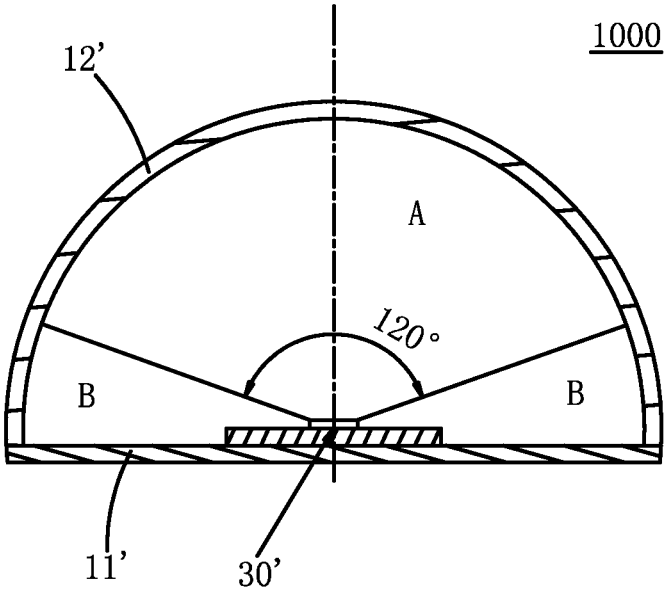
FIG. 1 (PRIOR ART)
FIG. 1 illustrates a conventional strip lamp's lateral view.

FIG. 1 illustrates a conventional strip lamp 1000's lateral view. The strip lamp 1000 includes an illuminating component 30', a body 11' and a lampshade 12'. The illuminating component 30' is disposed on the body 11''s center. Also, the illuminating component 30''s luminance span is around 120°. Assume that the illuminating component 30''s luminance span is defined as a region A. And assume that the illuminating component 30''s luminance shade (i.e., other than the luminance span) is defined as a region B. When the illuminating component 30' illuminates, the region A receives significantly larger luminance than the region B does. Specifically, it is because the region B receives merely reflected luminance from the lampshade 12'. As a result, the illuminating component 30's luminance primarily focuses on the region A, not the region B. Such that the conventional strip lamp 1000 illuminates in an extremely uneven manner.

For uniformizing the strip lamp's uneven luminance, the present disclosure provides a strip lamp 100 capable of illuminating uniformly.

Figure 2:
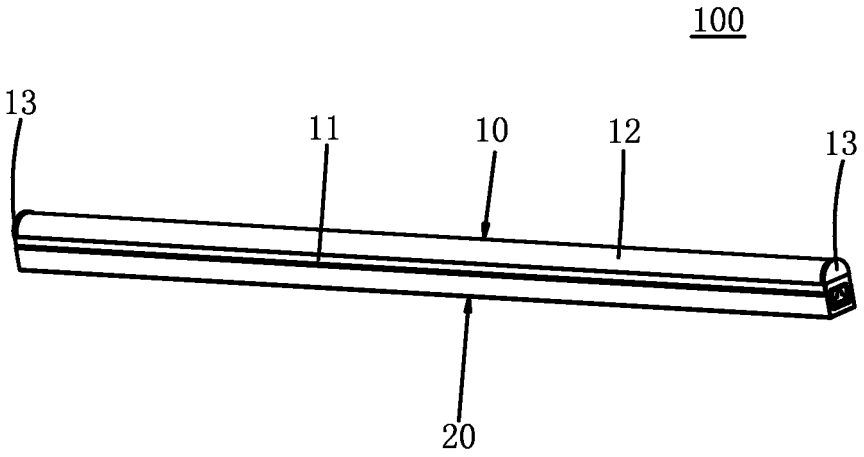
FIG. 2 illustrates a disclosed strip lamp according to one example.

FIG. 2 illustrates the disclosed strip lamp 100 according to one example. The strip lamp 100 includes a body 11, a lampshade 12, and an illuminating component 30 that is additionally covered and loaded by a holder 20.

Figure 3:
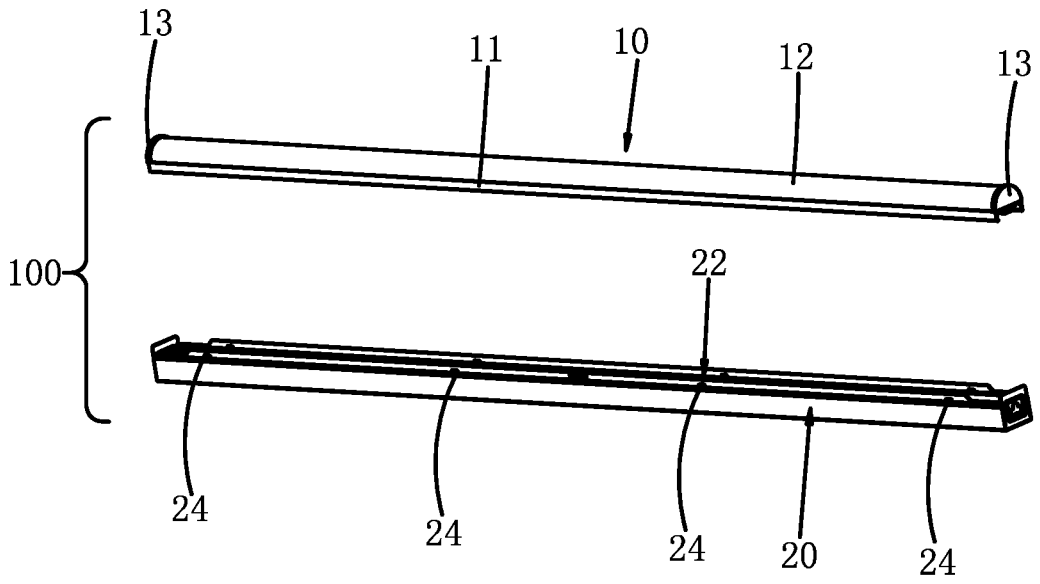
FIG. 3 illustrates the disclosed strip lamp's exploded diagram according to a first example.
Figure 4:
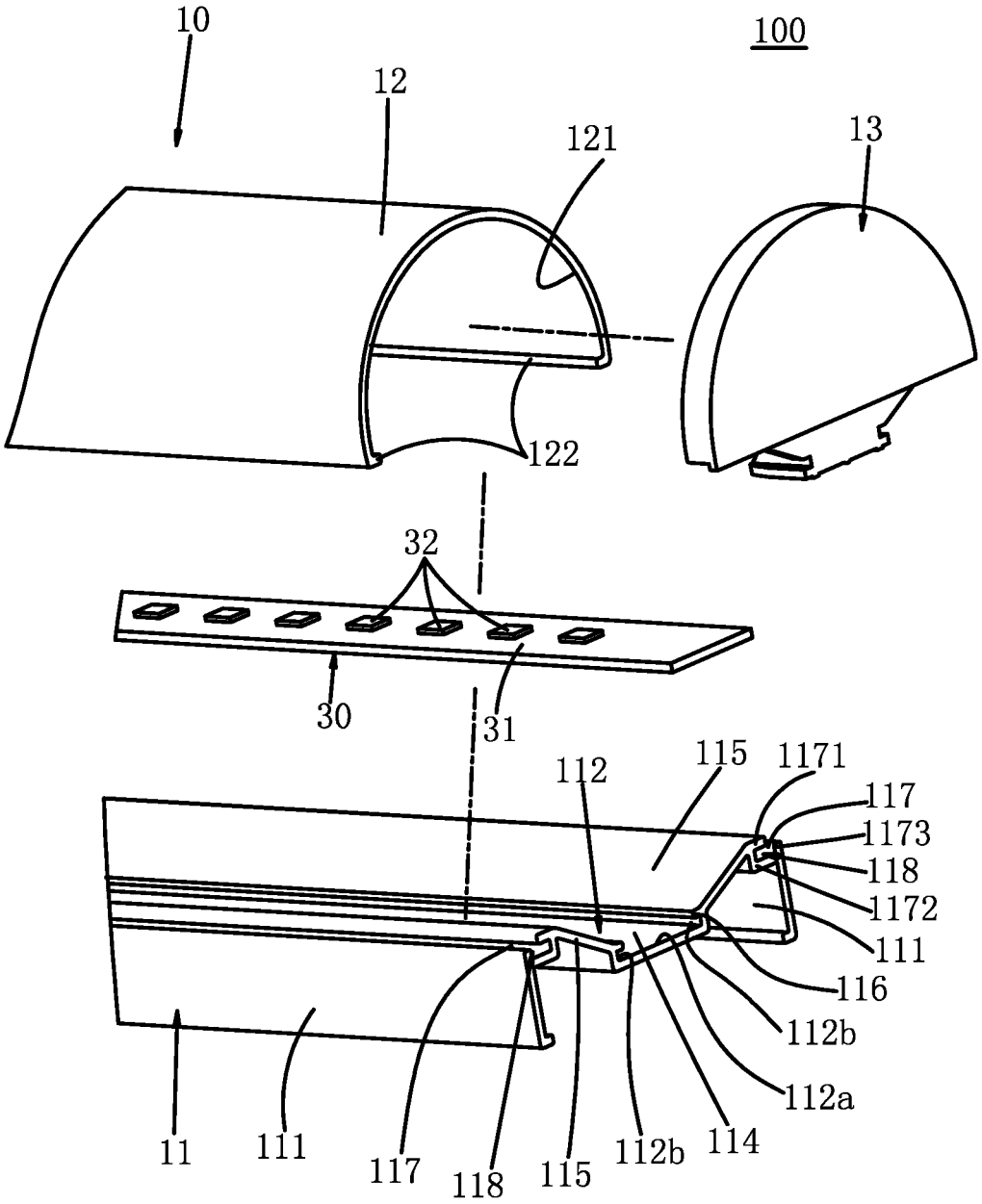
FIG. 4 illustrates the disclosed strip lamp's exploded diagram according to a second example that is more detailed than FIG. 3.
Figure 5:
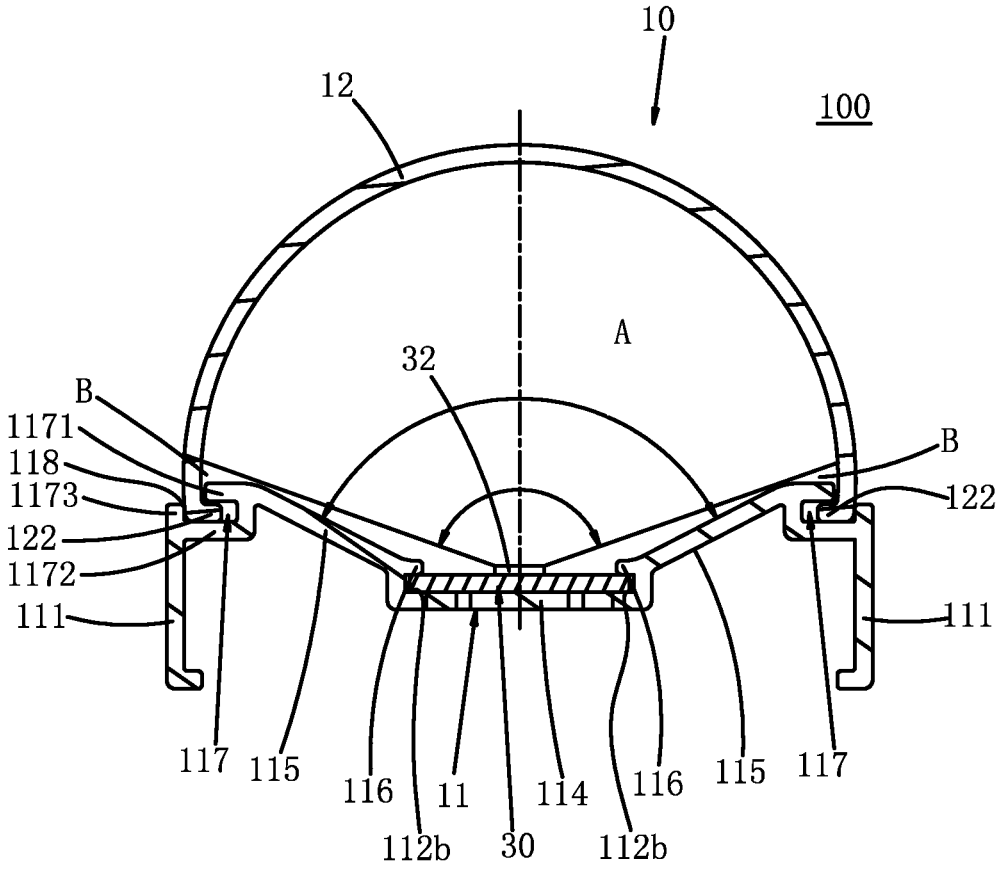
FIG. 5 illustrates the disclosed strip lamp's lateral view according to a third example.

FIG. 3 illustrates the strip lamp 100's exploded diagram according to a first example. Also, FIG. 4 illustrates the strip lamp 100's exploded diagram according to a second example that is more detailed than FIG. 3. FIG. 5 illustrates the strip lamp 100's lateral view according to a third example.

The body 11 includes a support wall 114 and a tilt wall 115 that is connected to the support wall 114's two opposite lateral sides. Also, the support wall 114 and the tilt wall 115 constitutes an installation chamber. Besides, the lampshade 12 has two opposite circumferential sides that is detachably connected to the tilt wall 115's two lateral sides.

The illuminating component 30 is installed on the support wall 114. And the illuminating component 30's illuminating surface faces towards the lampshade 12's inner surface.

Specifically, an included angle between the tilt wall 115's two opposite lateral sides is smaller or equal to the illuminating component 30's illuminating span angle.

In comparison to the conventional strip lamp 1000, the disclosed strip lamp 100 has a more uniform luminance distribution. It is because the illuminating component 30's all luminance substantially falls on the lampshade 12, i.e., all the luminance seldom falls off the lampshade 12's coverage. Such that the strip lamp 100's two lateral sides is substantially immune from dark regions that are basically eliminated by the tilt wall 115.

In comparison to the conventional strip light 1000 shown in FIG. 1, although both the conventional strip light 1000 and the disclosed strip light 100 utilize a same illuminating span angle (i.e., the angle shown in FIG. 1 and FIG. 5) for respective lampshades, the strip light 100 shown in FIG. 5 has a larger luminance span area A on the lampshade 12 than the luminance span area A' on the lampshade 12'. In other words, the luminance shade region B in FIG. 5 is significantly smaller than the luminance shade region B' in FIG. 1. Such that the disclosed strip light 100's luminance is much more uniform than the conventional strip light 1000's, especially at both the lateral sides. In addition, when the included angle between the tilt wall 115's two opposite lateral sides gets smaller, the illuminating component 30 can shed more concentrated lights on the lampshade 12 and therefore further reduces the luminance shade region B's area. And that better uniforms the disclosed strip light 100's luminance distribution.

Specifically, in one example, when the tilt wall 115 is disposed in a manner that reduces the included angle to substantially meet the illuminating span angle (can be substantially constant, depending on the illuminating component 30's hardware setting), the included angle now becomes a critical angle that refers to a maximal luminance span area A and a minimal luminance shade area B.

Figure 6:
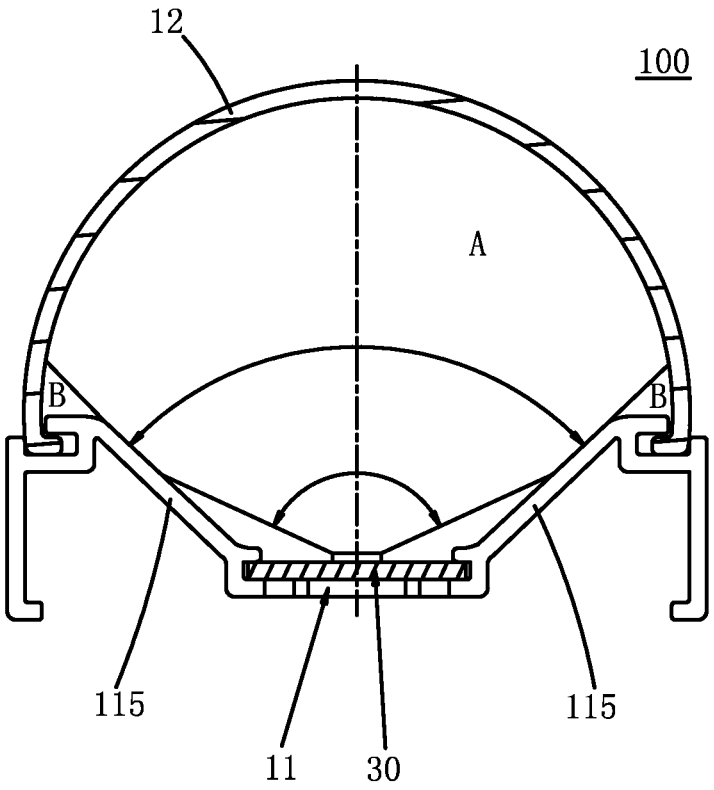
FIG. 6 illustrates an occasion that the disclosed strip lamp's included angle between the tilt wall's two lateral sides becomes smaller according to one example.

FIG. 6 illustrates an occasion that the disclosed strip lamp 100's included angle between the tilt wall 115's two lateral sides becomes smaller according to one example. Under such condition, lights from the illuminating component 30 travel along the tilt wall 115's two lateral sides and primarily focus on the lampshade 12. As the included angle shrinks to be smaller than the illuminating span angle, the strip lamp 100's actual illuminating angle shrinks correspondingly but also be more concentrated.

In some examples, both the body 11 and the lampshade 12 are strip-shaped. And the body 11 loads the illuminating component 30. In some other examples, the support wall 114 is connected to the tilt wall 115 in an integral manner.

In some examples, the lampshade 12 is made of a transparent material. And the lampshade 12 covers the illuminating component 30 for protection. In addition, in some examples, the lampshade 12 is half-cylinder-shaped. Such that the illuminating component 30's luminance is more uniformly distributed. Besides, each of the lampshade 12's lateral openings 121 can be capped by a corresponding terminal cap 13. In this way, the lamp component 10 includes the body 11, the lampshade 12, and several terminal caps 13.

As shown in FIG. 5, exemplarily, the illuminating component 30's illuminating span angle ▯ is substantially ranged between 115▯ and 125▯ may be approximately 120▯. In other words, the illuminating span angle ▯ is determined according to the illuminating component 30's hardware setting.

As shown in FIG. 4 and FIG. 5, the illuminating component 30 may include a base 31 and a planar bulb 32 that is disposed on the base 31's surface. Specifically, the base 31 is disposed on the support wall 114, such that the planar bulb 32 is also disposed on the support wall 114 along with the base 31. And it facilitates installation of the illuminating component 30. On top of that, the base 31 dissipates heat generated by the planar bulb 32 upon being activated. In some examples, the base 31 is made of metal for better dissipating the planar bulb 32's heat. And the dissipated heat is then transferred to the body 11 via the base 31. In some examples, the base 31 is strip-shaped, and the planar bulb 32 is a light emitting diode (LED) unit. Also, in some other examples, the base 31 loads multiple linear-aligned planar bulbs 32 that are separated by substantially-equal distances in between.

As shown in FIG. 4 and FIG. 5, in some examples, the support wall 114 further includes a groove 112 that in turn includes openings 112*a* at its both lateral sides. In this way, the base 31 can engage with the groove 112 via the openings 112*a*, for example, with the aid of a tongue-and-groove fit or a snap-in fit. Such that the base 31 detachably engages with the body 11 without being easily separated by an unexpected external force.

As shown in FIG. 4 and FIG. 5, in some examples, the groove 112 has two mutually-opposite-faced recesses 112*b*. Also, a tongue 116 is disposed at the intersection of the support wall 114 and the tilt wall 115. And each the recess 112*b* is formed between a corresponding tongue 116 and the support wall 114. Upon installation, the base 31 is pushed into the groove 112 via the openings 112*a* in a manner that the base 31's two opposite edges respectively enter the recesses 112*b*. Such that the base 31 detachably engages on the body 11.

As shown in FIG. 4 and FIG. 5, in some examples, the tilt wall 115 is symmetrically disposed around the support wall 114's two opposite lateral sides. And the planar bulbs 32 are linearly aligned along the support wall 114, for example, along the support wall 114's center line. Consequently, most lights from the planar bulbs 32 directly penetrate through the lampshade 12. And it significantly eliminates the luminance shade region B from the strip lamp 100.

As shown in FIG. 4 and FIG. 5, in some examples, several hooks 122 form at the lampshade 12's opposite sides. Additionally, the tilt wall 115 includes an indentation 117 at its external side for detachably engaging a corresponding hook 122, for example, in a groove-and-tongue fit or a snap-in fit. Such that the lampshade 12 detachably engages with the body 11 for installation.

As shown in FIG. 4 and FIG. 5, in some examples, the tilt wall 115 has a first limiter 1171 that extends from the tilt wall 115's external side. Besides, the tilt wall 115 has another positioning wall 1172 that extends from the tilt wall 115's external side. And in turn, a second limiter 1173 extends from the positioning wall 1172. Specifically, a combination of the first limiter 1171, the positioning wall 1172 and the second limiter 1173 forms a C-shaped hook that surrounds the indentation 117. An installation opening 118 is formed in between the first limiter 1171 and the second limiter 1173. In addition, the installation opening 118 substantially connects with the indentation 117. The first limiter 1171 detachably engages with the hook 122 for limiting the lampshade 12's vertical relative movement with the body 11 and for therefore engaging the lampshade 12 on the body 11. The second limiter 1173 limits the lampshade 12's lateral movement and therefore stops the lampshade 12 from detaching from the indentation 117. Upon installation, the hook 122 engages with the indentation 117 via the installation opening 118, for example, by a groove-and-tongue fit or a snap-in fit, for detachably engaging the lampshade 12 with the body 11 in a convenient and reliable manner.

Figure 7:
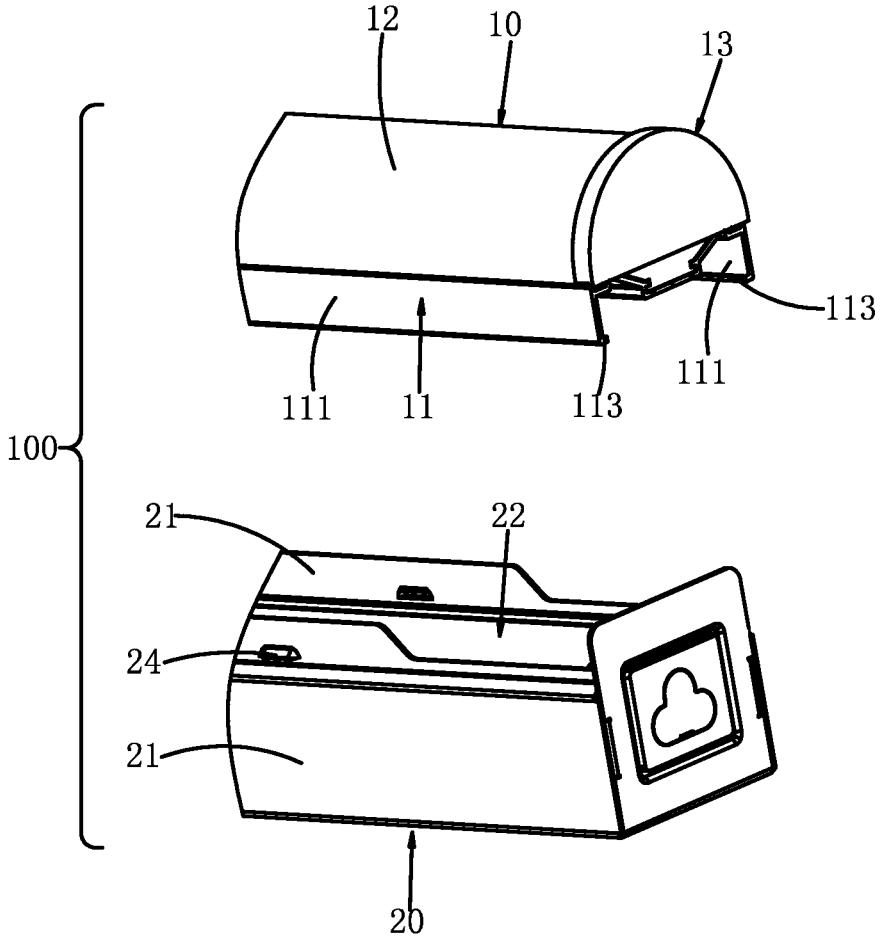
FIG. 7 illustrates the disclosed strip lamp's exploded view according to one example.

As shown in FIG. 3 and FIG. 7, the strip lamp 100 includes the holder 20 that in turn includes two separated first sidewalls 21. In addition, an installation opening 22 is formed in between the two first sidewalls 21. Specifically, the two first sidewalls 21 extend along the strip lamp 100's longitudinal axis. Additionally, as shown in FIG. 4, the body 11 further includes two second sidewalls 111 that connect to the tilt wall 115's external side. Besides, the second sidewalls 111 act as the body 11's sidewalls that extends along the strip lamp 100's longitudinal axis. When the body 11 is installed onto the holder 20, the second sidewalls 111 that are located at the support wall 114's two opposite sides are disposed external to the two first sidewalls 21 respectively. Moreover, the body 11 covers and clamps the installation opening 22. Such that the body 11 detachably engages with the holder 20.

In some examples, the holder 20 is strip-shaped. Exemplarily, the holder 20 may also be a rectangular housing. Also, the installation opening 22 can be used for holding other required elements for the strip lamp 100, such as a control panel.

As shown in FIG. 3 and FIG. 7, the first sidewall 21 further has a first snap 24. And the second sidewall 111 has a second snap 113 that can engage with the first snap 24 using a snap-in fit. Such that the body 11 can be better detachably engaged with the holder 20. In some examples, both sides of the holder 20 respectively include an outwardly-extending first snap 24, and both sides of the body 11 respectively include an inwardly-extending second snap 113. Therefore, while installing the body 11 onto the holder 20 via the installation opening 22, by detachably engaging or disengaging the first snap 24 with or from the second snap 113, the body 11 can be reliably engaged with the holder 20 as well as disengaged from the holder 20. In some other examples, the first snaps 24 are protrusions disposed on the holder 20, and the second snaps 113 are grooves disposed corresponding to the first snaps 24. In this way, the second snaps 113 can form a groove-and-tongue fit with the first snaps 24 along the strip lamp 100's longitudinal axis for reliably engaging the body 11 with the holder 20.

The invention claimed is:

1. A strip lamp, comprising:

a body, comprising:

a support wall; and a tilt wall, connected to the two opposite lateral sides of the support wall, and configured to form an included angle between the two opposite lateral sides of the support wall;

a lampshade, detachably engaged with the body, and detachably connected to both of the two opposite lateral sides of the tilt wall;

an illuminating component, installed on the support wall to face against an inner surface of the lampshade, wherein an illumination span angle of the illuminating component is smaller than or equal to an included angle of the tilt wall;

an indentation, disposed at an external side of the tilt wall; and a holder, detachably engaged with the body, and configured to load the illuminating component, wherein the illuminating component comprises a base disposed on the support wall and a planar bulb disposed on a surface of the base, wherein the support wall comprises a groove, wherein the groove comprises two openings respectively disposed at the two lateral sides of the support wall, wherein the base is further configured to engage with the groove via a tongue-and-groove fit or a snap-in fit, wherein the groove further comprises two mutually-opposite-faced recesses, wherein the strip lamp further comprises a tongue, disposed at an intersection of the support wall and the tilt wall, and wherein each of the recesses is formed between a corresponding tongue and the support wall, wherein the illuminating component's illuminating span angle is substantially ranged between 115° and 125°, wherein the lampshade is half-cylinder-shaped, wherein the tilt wall has a first limiter extending from the external side of the tilt wall, the tilt wall has another positioning wall extending from the external side of the tilt wall, the tilt wall has a second limiter extending from the positioning wall, wherein a combination of the first limiter, the positioning wall and the second limiter forms a C-shaped hook that surrounds the indentation, wherein the first limiter limits a vertical movement of the lampshade with respect to the body, wherein the second limiter limits a lateral movement of the lampshade with respect to the body to stop the lampshade from detaching from the indentation.

2. The strip lamp of claim 1, wherein both the body and the lampshade are strip-shaped.

3. The strip lamp of claim 1, wherein the support wall is connected to the tilt wall in an integral manner.

4. The strip lamp of claim 1, wherein the lampshade comprises a transparent material.

5. The strip lamp of claim 1, further comprising:

a terminal cap, configured to cap a lateral opening of the lampshade.

6. The strip lamp of claim 1, wherein the illuminating component's illuminating span angle is approximately 120°.

7. The strip lamp of claim 1, wherein the base comprises a metal material.

8. The strip lamp of claim 1, wherein the base is strip-shaped.

9. The strip lamp of claim 1, wherein the planar bulb comprises a light-emitting diode (LED) unit.

10. The strip lamp of claim 1, wherein the base is further configured to be pushed into the groove via the groove's openings for entering into the groove.

11. The strip lamp of claim 1, wherein the tilt wall is symmetrically disposed around the support wall's two opposite lateral sides.

12. The strip lamp of claim 11, wherein the planar bulb comprises:

a plurality of linear-aligned planar bulbs, disposed on the base's surface, and separated in substantially-equal distances.

13. The strip lamp of claim 1, wherein the plurality of planar bulbs are linearly aligned along a center line of the support wall.

* * * * *